US007305781B1

(12) United States Patent
Mowry

(10) Patent No.: US 7,305,781 B1
(45) Date of Patent: Dec. 11, 2007

(54) PICTURE FRAME ASSEMBLY

(76) Inventor: Holly L. Mowry, 3077 Olympia Dr., Decatur, IL (US) 62521

( * ) Notice: Subject to any disclaimer, the term of this patent is extended or adjusted under 35 U.S.C. 154(b) by 127 days.

(21) Appl. No.: 11/389,270

(22) Filed: Mar. 24, 2006

Related U.S. Application Data

(60) Provisional application No. 60/755,143, filed on Dec. 30, 2005.

(51) Int. Cl.
*G09F 19/00* (2006.01)

(52) U.S. Cl. ..... 40/124.5; 40/645; 40/718; 40/766; 40/607.05

(58) Field of Classification Search ..... 40/645, 40/649, 124.5, 607.06, 607.05, 718, 732, 40/453, 606.1, 766; 47/44–47
See application file for complete search history.

(56) References Cited

U.S. PATENT DOCUMENTS

| | | | | |
|---|---|---|---|---|
| 1,444,449 | A * | 2/1923 | Beck | 40/606.1 |
| 1,896,695 | A * | 2/1933 | Borovicka | 40/645 |
| 2,186,428 | A * | 1/1940 | Patten | 40/645 |
| 3,935,653 | A * | 2/1976 | Klein | 40/606.13 |
| 4,534,125 | A * | 8/1985 | Buck | 40/645 |
| 4,790,088 | A | 12/1988 | Morvant | 40/124.5 |
| 6,022,599 | A * | 2/2000 | Rietveld et al. | 428/14 |
| D501,891 | S * | 2/2005 | Kaplan et al. | D20/41 |
| 6,898,879 | B2 | 5/2005 | Regelin | 40/124.5 |
| 2002/0184798 | A1 | 12/2002 | McGovern | 40/124.5 |
| 2003/0131513 | A1 | 7/2003 | Runge | 40/718 |
| 2004/0139633 | A1 * | 7/2004 | Shannon | 40/124.5 |

* cited by examiner

*Primary Examiner*—Christopher P. Ellis
*Assistant Examiner*—Christopher E Veraa
(74) *Attorney, Agent, or Firm*—Philip L. Bateman

(57) ABSTRACT

A weatherproof gravesite picture frame assembly displays photographs, letters, cards, and other flat memorabilia at a gravesite. The assembly has a planar frame, an elongated stake, and an elastomeric collar. The frame has an inner recess for receiving a picture, a slot opening in its top surface for inserting and removing the picture, and a shallow channel along its perimeter. The collar has front and rear flanges and a raised wall that runs along its inner surface and mates with the channel of the frame.

12 Claims, 2 Drawing Sheets

10
20
21
22
23
30
31
40
41
42
43
50
2
3
4

PICTURE FRAME ASSEMBLY

CROSS-REFERENCE TO RELATED APPLICATION

This application claims the benefit of U.S. Provisional Application Ser. No. 60/755,143, Dec. 30, 2005.

FIELD OF THE INVENTION

This invention relates to picture frames. More particularly, this invention relates to weatherproof interchangeable gravesite picture frame assemblies.

BACKGROUND OF THE INVENTION

Since prehistoric times, humans have placed memorabilia at the grave sites of their loved ones. In modern times, the memorabilia are often photographs, cards, letters, and other flat items which are herein referred to collectively as "pictures." These items are often placed in picture frames for display and preservation. Conventional picture frames contain a transparent front face, a recess for receiving the picture, and a means for inserting and removing the picture. Most picture frames are designed for display indoors and are not weatherproof. Accordingly, pictures in conventional picture frames at gravesites eventually become ruined by exposure to water unless they are laminated or otherwise weatherproofed before being placed into the picture frame.

Some picture frames contain a more effective seal to protect the pictures from the weather. For example, Runge, U.S. Pat. Appln. No. 2003/0131513, Jul. 17, 2003, discloses a display device having an inner elastomeric seal between the front and rear faces and also having an elastomeric frame with a C-shaped cross section that surrounds the edges of the front and rear faces. The Runge display device is not adapted for use at a gravesite and its sealing system potentially allows water to enter at any point around the perimeter.

Some picture frames display a picture that is permanently sealed. For example, Morvant, U.S. Pat. No. 4,790,088, Dec. 13, 1988, discloses a permanent grave marker in which a laminated picture is glued into a frame. These frames are suitable for display outside. However, the picture cannot be changed because of the permanent seal.

Picture frames that are somewhat weatherproof, changeable, and especially adapted for use at a gravesite have also been disclosed. For example, McGovern, U.S. Pat. Appln. Publn. No. 2002/0184798, Dec. 12, 2002, discloses a gravesite marker consisting of a frame on a stake. The frame contains a slot for inserting and removing a picture. The slot is located on the side of the frame if reduced damage from the elements is desired. Regelin, U.S. Pat. No. 6,898,879, May 31, 2005, discloses a gravesite memory marker also consisting of a frame on a stake. The frame consists of front face and a rear face that are attached together with a hinge. Its sealing system potentially allows water to enter around the complete perimeter except for the hinge.

Accordingly, there is a demand for an improved picture frame. More particularly, there is a demand for a completely weatherproof interchangeable picture frame that is especially adapted for use at a gravesite.

SUMMARY OF THE INVENTION

The general object of this invention is to provide an improved picture frame. A more particular object is to provide a completely weatherproof interchangeable picture frame that is especially adapted for use at a gravesite.

I have invented an improved weatherproof interchangeable gravesite picture frame assembly. The assembly comprises: (a) a planar frame having a transparent front face, a rear face, a top surface, a bottom surface, and a perimeter, the frame having an inner recess between the front and rear faces for receiving a picture, the frame having a slot opening in its top surface that communicates with the recess for inserting and holding a picture, the recess being fully enclosed except for the slot, the frame having a perimeter with a shallow channel; (b) an elongated stake connected to the frame; and (c) an elastomeric sealing collar for placement onto the frame to prevent water from entering the recess, the collar having a shape and size that surrounds the perimeter of the frame, the collar having an opening for the stake, the collar having front and rear flanges that extend onto and in contact with the front and rear faces of the frame, the collar having an inner surface and a raised wall that runs along with the inner surface that mates with the channel in the perimeter of the frame when the collar is placed onto the frame.

The picture frame assembly of this invention is completely weatherproof and yet pictures are easily interchanged because of its unique seal. The picture frame assembly is especially adapted for use at a gravesite because of these properties and also because of its stake.

DETAILED DESCRIPTION OF THE INVENTION

Figures 1, 2, 3, 4:
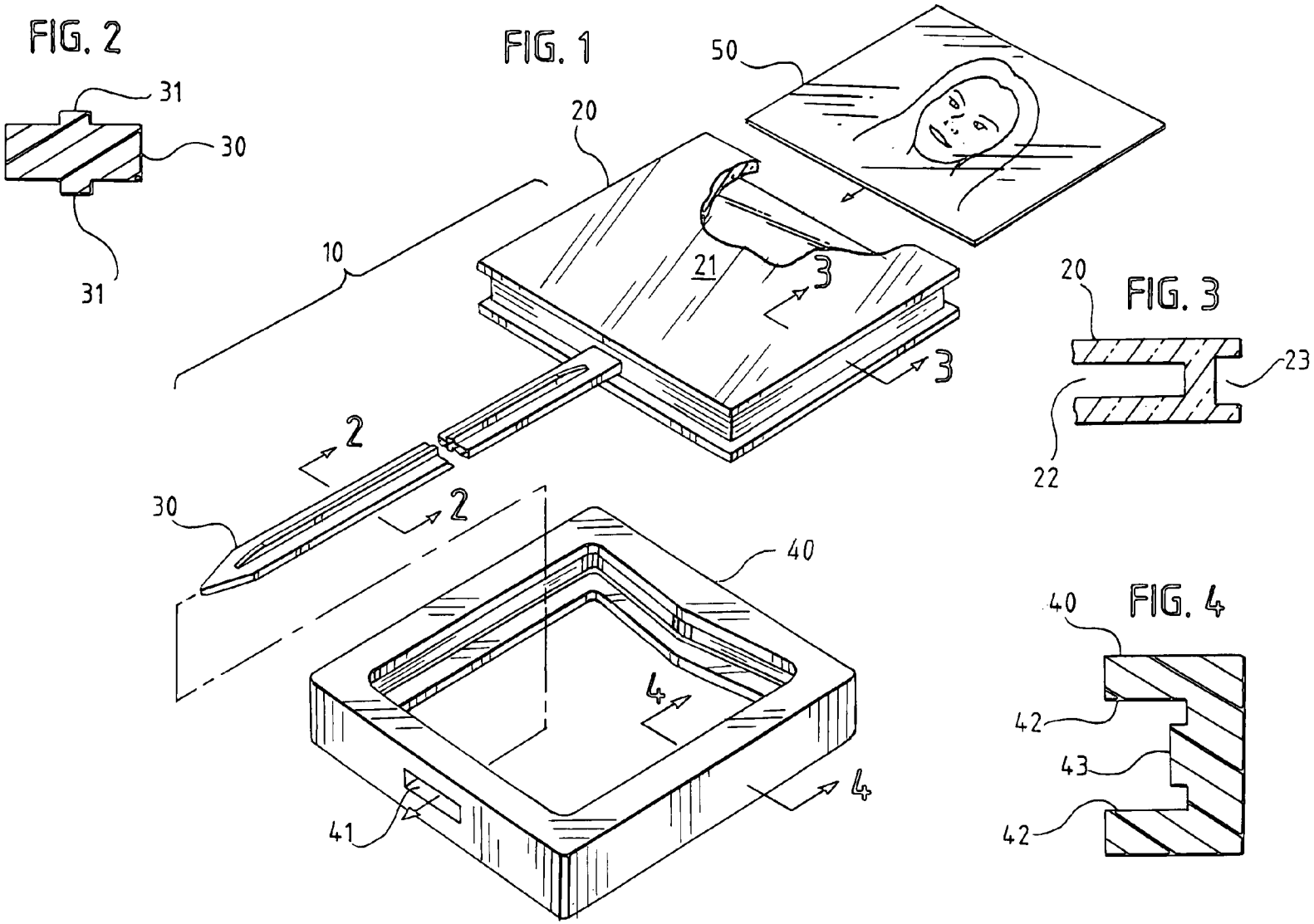
FIG. 1 is an exploded, perspective, and partially broken view of a preferred embodiment of the picture frame assembly of this invention.
FIG. 2 is a section of the stake taken along line 2-2 of FIG. 1.
FIG. 3 is a section of the frame taken along line 3-3 of FIG. 1.
FIG. 4 is a section of the collar taken along line 4-4 of FIG. 1.

This invention is best understood by reference to the drawings. The picture frame assembly 10 consists of a frame 20, a stake 30, and a collar 40. The frame is adapted to receive a picture 50, but the picture is not a part of the invention. The picture shown is a photograph, but other flat items such as cards, letters, notes, drawings, etc. are also advantageously displayed in the picture frame assembly. Each of the components is discussed in turn below.

The frame 20 is a planar receptacle for a picture. The frame has a transparent front face 21 so the picture can be seen. All or substantially all of the front face is preferably transparent so that the maximum amount of the picture can be seen. The frame preferably also has a transparent rear face so that both sides of a two-sided picture or two different pictures can be displayed simultaneously. The frame is preferably made of a clear material such as polycarbonate, polystyrene, glass, or the like. The most preferred clear material is polycarbonate because of its strength, cost, and ease of molding. The frame is generally manufactured by attaching two pieces together. The attachment is preferably made by ultrasonic welding, but gluing with a suitable waterproof glue is also suitable. The frame has an inner recess 22 between the front and rear faces for holding the picture. The recess is best seen in FIG. 3. A slot opening in the top of the frame communicates with the recess and enables the picture to be inserted and removed. The recess is completely enclosed around the rest of the perimeter so that the only opening (and the only possible place for water to enter the recess) is through the slot.

The frame is typically rectangular in shape because most pictures are rectangular. However, other shapes are also suitable. The size of the frame is a matter of choice. It generally has dimensions of height and width to accommodate standard sized photographs, for example, two and one-fourth by three and one-half inches (billfold size), three and one-half by five inches, four by six inches, five by seven inches, etc. The frame generally has a thickness (depth) of about one-quarter inch. The perimeter of the frame preferably contains a channel 23 that runs along at least substantially all of the perimeter. The channel is best seen in FIG. 3. As discussed in detail below, the purpose of the channel is to mate with the collar to provide a weatherproof seal. The channel is shallow and generally has a depth of less than about one-half inch and preferably less than about one-fourth inch.

The stake 30 is an elongated member that is connected to the bottom surface of the frame. The stake preferably has a sharpened distal end so that it can penetrate the ground at a gravesite. The stake is preferably integral with the frame. However, the stake may be removably connected to the frame. The stake preferably contains reinforcing ribs 31 on its front and rear surfaces. The ribs are best seen in FIG. 2. The dimensions of the stake are also a matter of choice. The stake is generally about six inches to three feet long and is preferably about one foot long.

The collar 40 fits around the perimeter of the frame and seals the slot so that no water can enter the recess and damage the picture. The collar is made of an elastomeric material such as natural rubber, synthetic rubber, or the like. The preferred elastomer is SANTOPRENE thermoplastic elastomer, a polypropylene modified butyl rubber which is a commercial product of Advanced Elastomer Systems, L.P. of Akron, Ohio. This synthetic rubber elastomer is preferred because of its flexibility and resistance to sunlight and the other elements. The shape and size of the collar are determined by the shape and size of the frame.

The collar has an opening 41 in its bottom surface for accommodating the stake. The collar has front and rear flanges 42 that extend onto and in contact with the front and rear surfaces of the frame. The inner surfaces of the flanges are parallel to the front and rear surfaces of the frame to maximize the cross-sectional area of contact and thereby minimize the possibility of water reaching the picture(s) in the frame. The corners are preferably curved slightly to reduce the possibility of tearing. The front and rear flanges along the top preferably angle downward from each corner to form a V shape. The downward angle helps to direct water away from the corners. The inner surface of the collar preferably contains a raised wall 43 that that runs along at least substantially all of the inner surface and that mates with the channel in the perimeter of the frame. The flanges and the raised wall are best seen in FIG. 4.

Figure 5:
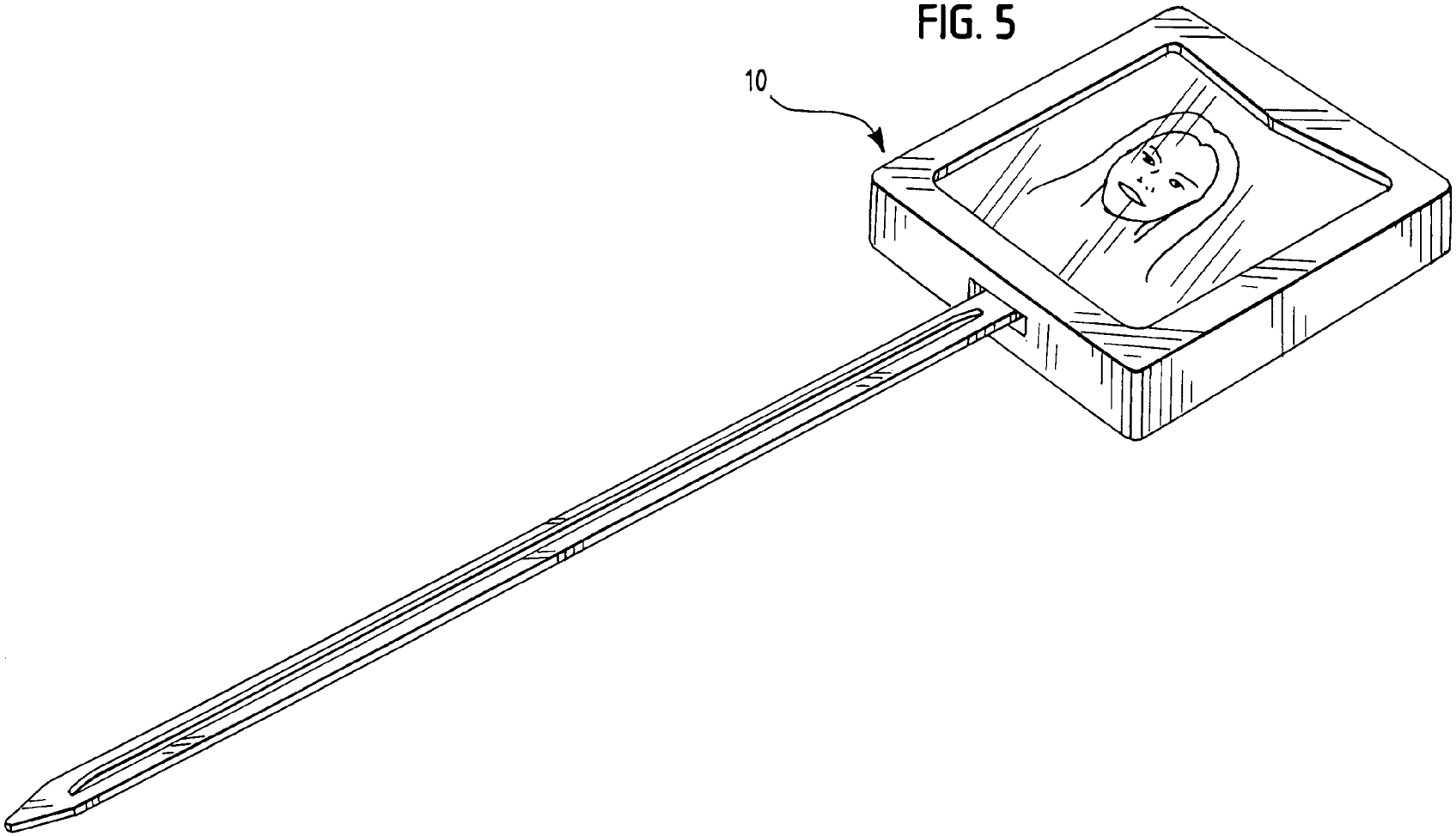
FIG. 5 is an assembled perspective view of a preferred embodiment of the picture frame assembly of this invention.

The picture frame assembly is assembled by first inserting a picture into the slot of the frame. The distal end of the stake is then placed through the opening in the collar and the collar is slid upward along the stake to the frame. The collar is then stretched around the perimeter of the frame and worked into position. When properly positioned, the raised wall of the collar mates with (fits within) the channel of the frame and the front and rear flanges of the collar are flat against the front and rear surfaces of the frame. The assembled picture frame assembly is shown in FIG. 5. The picture frame assembly is exceptionally weatherproof because of the tight seal made between the frame and the collar. A picture inside the picture frame assembly remains dry even if the assembly is exposed to torrential rains or extremely humid conditions.

I claim:

1. A weatherproof gravesite picture frame assembly comprising:

(a) a planar frame having a transparent front face, a rear face, a top surface, a bottom surface, and a perimeter, the frame having an inner recess between the front and rear faces for holding a picture, the frame having a slot opening in its top surface that communicates with the recess for inserting and removing a picture, the recess being fully enclosed except for the slot;

(b) an elongated stake connected to the frame; and (c) an elastomeric sealing collar for placement onto the frame to prevent water from entering the recess, the collar having a shape and size that surrounds the perimeter of the frame, the collar having an opening for the stake, the collar having front and rear flanges that extend onto and in contact with the front and rear faces of the frame, the collar having an inner surface.

2. The picture frame assembly of claim 1 wherein the perimeter of the frame contains a channel running along at least substantially all the perimeter.

3. The picture frame assembly of claim 2 wherein the inner surface of the collar contains a raised wall running along at least substantially all the inner surface that mates with the channel in the perimeter of the frame.

4. The picture frame assembly of claim 3 wherein the elongated stake is connected to the bottom surface of the frame and has a sharpened distal end for penetrating into ground.

5. The picture frame assembly of claim 4 wherein the frame and stake are integral.

6. The picture frame assembly of claim 5 wherein the rear face is transparent.

7. The picture frame assembly of claim 6 wherein the frame is made of polycarbonate.

8. The picture frame assembly of claim 3 wherein the collar is made of a synthetic rubber.

9. The picture frame assembly of claim 8 wherein the front and rear flanges along the top angle downward from the corners to form a V shape.

10. The picture frame assembly of claim 9 wherein the frame and collar are rectangular and wherein the corners of the flanges of the collar are curved.

11. The picture frame assembly of claim 10 wherein the front and rear flanges of the collar are parallel to each other.

12. The picture frame assembly of claim 11 wherein the collar is made of a polypropylene modified butyl rubber.

* * * * *